US012582882B2

(12) United States Patent
Nakano

(10) Patent No.: US 12,582,882 B2
(45) Date of Patent: Mar. 24, 2026

(54) GOLF CLUB SHAFT

(71) Applicant: SUMITOMO RUBBER INDUSTRIES, LTD., Kobe (JP)

(72) Inventor: Takashi Nakano, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 799 days.

(21) Appl. No.: 17/901,179

(22) Filed: Sep. 1, 2022

(65) Prior Publication Data

US 2023/0079056 A1 Mar. 16, 2023

(30) Foreign Application Priority Data

Sep. 14, 2021 (JP) ..... 2021-149434

(51) Int. Cl.
*A63B 53/10* (2015.01)
*A63B 60/14* (2015.01)

(52) U.S. Cl.
CPC ..... *A63B 53/10* (2013.01); *A63B 60/14* (2015.10); *A63B 2209/02* (2013.01)

(58) Field of Classification Search
CPC ..... A63B 53/10; A63B 60/14; A63B 2209/02
USPC ..... 473/319
See application file for complete search history.

(56) References Cited

U.S. PATENT DOCUMENTS 7,918,746 B2 * 4/2011 Kumamoto ..... A63B 53/10 473/319
9,399,159 B2 * 7/2016 Nakamura ..... A63B 60/00
10,213,668 B2 * 2/2019 Takeuchi ..... A63B 53/12
10,420,995 B2 * 9/2019 Takasu ..... A63B 60/42
11,007,412 B2 * 5/2021 Takasu ..... A63B 53/10
12,274,925 B2 * 4/2025 Motokawa ..... A63B 53/0408
2004/0038744 A1 * 2/2004 Kumamoto ..... B32B 5/28 473/319
2008/0070716 A1 * 3/2008 Kumamoto ..... A63B 53/10 473/319
2009/0069109 A1 * 3/2009 Kumamoto ..... A63B 53/10 473/319
2016/0346651 A1 * 12/2016 Nakamura ..... A63B 53/10
2018/0001166 A1 * 1/2018 Nakano ..... A63B 53/10
2019/0009148 A1 * 1/2019 Takasu ..... A63B 60/42
2020/0338409 A1 * 10/2020 Takasu ..... A63B 53/10

FOREIGN PATENT DOCUMENTS

JP 2014-171582 A 9/2014

* cited by examiner

*Primary Examiner* — Essama Omgba

(74) *Attorney, Agent, or Firm* — Birch, Stewart, Kolasch & Birch, LLP

(57) ABSTRACT

A shaft has a weight of 50 g or less. A forward flex is 110 mm or less. A backward flex is 100 mm or less. A shaft torque is 4.0° to 6.5°. The shaft includes a first hoop layer, a second hoop layer longer than the first hoop layer, and a third hoop layer longer than the second hoop layer. An outer diameter at a position 550 mm apart from a tip end is D5. An outer diameter at a position 950 mm apart from the tip end is D9. A crushing strength at the position 550 mm apart from the tip end is F5. A crushing strength at the position 950 mm apart from the tip end is F9. F5/D5 is 1.5 or greater and 2.5 or less. F9/D9 is 1.0 or greater and 2.0 or less. A difference (F5−F9) is 4 kgf or less.

16 Claims, 7 Drawing Sheets

GOLF CLUB SHAFT

CROSS REFERENCE TO RELATED APPLICATION

This application claims priority to Japanese Patent Application No. 2021-149434 filed on Sep. 14, 2021. The entire contents of this Japanese Patent Application are hereby incorporated by reference.

BACKGROUND

Technical Field

The present disclosure relates to golf club shafts.

Description of the Related Art

A lightweight shaft is advantageous for improvement of flight distance. A reduction in weight, however, can reduce the flexural rigidity of the shaft. JP2014-171582A discloses a shaft that has a reduced weight while retaining flexural rigidity.

SUMMARY

Competitive golfers having relatively high physical strength is also referred to as athlete-type golfers. From the viewpoint of feeling, many athlete-type golfers cannot use a lightweight shaft. If such athlete-type golfers can use a lightweight shaft, they can effectively improve flight distance. In addition, if athlete-type golfers having weakened muscles due to aging can use a lightweight shaft, they can recover their ball flight distance.

One example of the present disclosure is to provide a golf club shaft that is excellent in feeling for athlete-type golfers even when the shaft is lightweight.

A golf club shaft according to one aspect is formed by a plurality of fiber reinforced resin layers and includes a tip end and a butt end. The shaft has a shaft weight of less than or equal to 50 g. The shaft has a forward flex of less than or equal to 110 mm. The shaft has a backward flex of less than or equal to 100 mm. The shaft has a shaft torque of greater than or equal to 4.0° and less than or equal to 6.5°. The fiber reinforced resin layers include a first hoop layer that is disposed from the butt end to a first position, a second hoop layer that is longer than the first hoop layer and is disposed from the butt end to a second position, and a third hoop layer that is longer than the second hoop layer and is disposed from the butt end to a third position. An outer diameter of the shaft at a position located 550 mm apart from the tip end is denoted by D5 (mm), an outer diameter of the shaft at a position located 950 mm apart from the tip end is denoted by D9 (mm), a crushing strength of the shaft at the position located 550 mm apart from the tip end is denoted by F5 (kgf), and a crushing strength of the shaft at the position located 950 mm apart from the tip end is denoted by F9 (kgf). A ratio F5/D5 is greater than or equal to 1.5 and less than or equal to 2.5. A ratio F9/D9 is greater than or equal to 1.0 and less than or equal to 2.0. A difference (F5−F9) is less than or equal to 4 kgf.

DESCRIPTION OF THE PREFERRED EMBODIMENTS

Embodiments of the present disclosure will be described in detail below with reference to the drawings as necessary.

The term "layer" and the term "sheet" are used in the present disclosure. The "layer" is a term used for after being wound. In contrast, the "sheet" is a term used for before being wound. The "layer" is formed by winding the "sheet". That is, the wound "sheet" forms the "layer".

In the present disclosure, the same symbol is used in the layer and the sheet. For example, a layer formed by a sheet s1 is referred to as a layer s1.

In the present disclosure, the term "axial direction" means the axial direction of a shaft. In the present disclosure, the term "circumferential direction" means the circumferential direction of a shaft. Unless otherwise described, the term "length" in the present disclosure means a length in the axial direction. Unless otherwise described, the term "position" in the present disclosure means a position in the axial direction. Unless otherwise described, the term "inside" and "inner side" in the present disclosure means the inside in the radial direction (radial inside) of the shaft. Unless otherwise described, the term "outside" and "outer side" in the present disclosure means the outside in the radial direction (radial outside) of the shaft.

Figure 1:
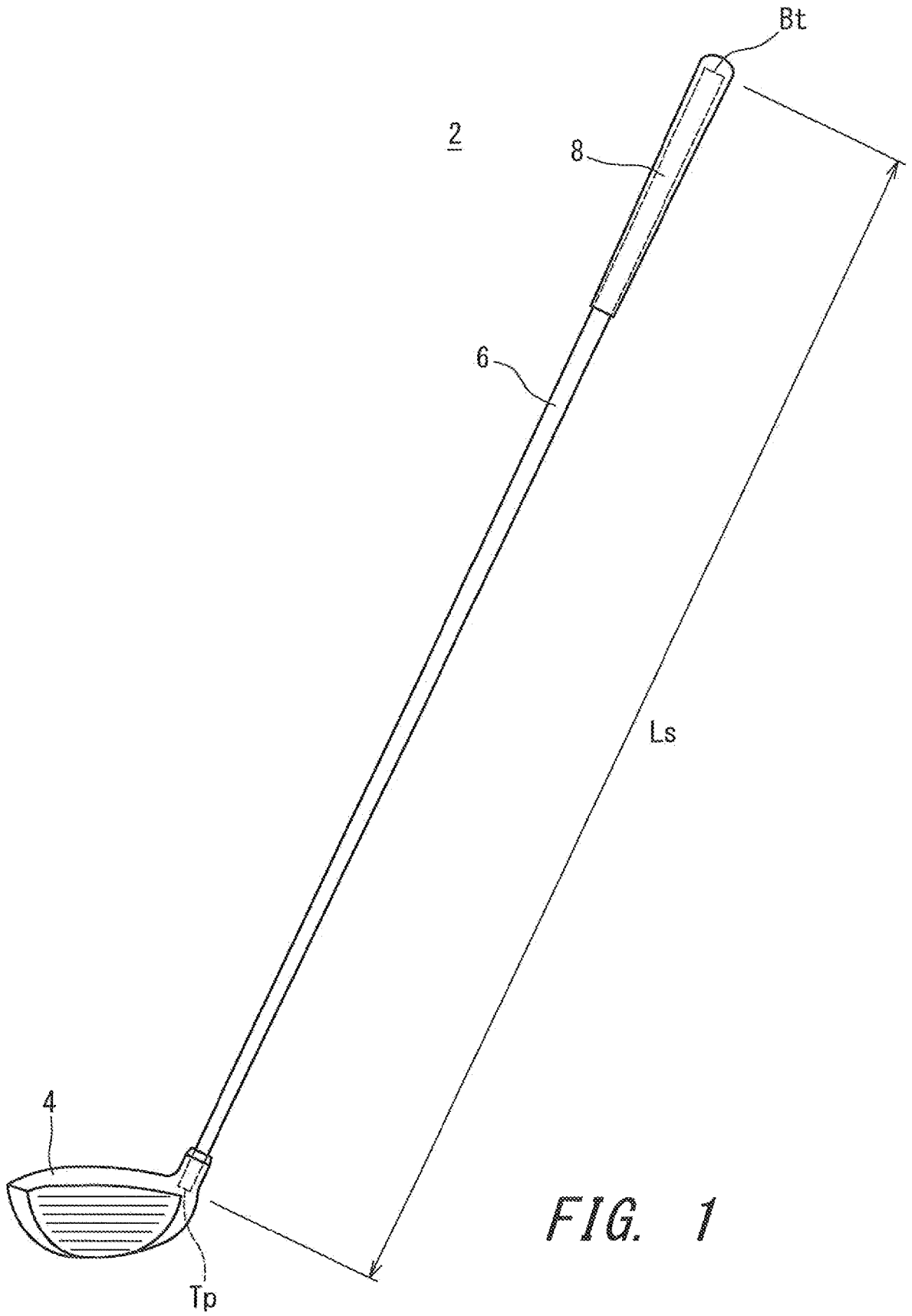
FIG. 1 shows an overall view of a golf club that includes a golf club shaft according to an embodiment.

FIG. 1 shows a golf club 2 in which a golf club shaft 6 according to the present disclosure is attached. The golf club 2 includes a head 4, the shaft 6, and a grip 8. The head 4 is provided at a tip portion of the shaft 6. The grip 8 is provided at a butt portion of the shaft 6. The shaft 6 is a shaft for a wood type club. The golf club 2 is a driver (number 1 wood). The shaft 6 is a shaft used for drivers.

There is no limitation on the head 4 and the grip 8. Examples of the head 4 include a wood type head, a utility type head, an iron type head, and a putter head. In the present embodiment, the head 4 is a wood type head. In the present embodiment, the head 4 is a driver head.

The shaft 6 is formed by a plurality of fiber reinforced resin layers. The kind of fibers is not limited. In the present embodiment, a carbon fiber reinforced resin layer and a glass fiber reinforced resin layer are used as the fiber reinforced resin layers. The shaft 6 is in a tubular form. Although not shown in the drawings, the shaft 6 has a hollow structure. The shaft 6 includes a tip end Tp and a butt end Bt. In the golf club 2, the tip end Tp is located inside the head 4. In the golf club 2, the butt end Bt is located inside the grip 8.

The shaft 6 includes a tapered portion in which an outer diameter of the shaft 6 continuously increases toward the butt end Bt. In the shaft 6, at least a region that extends from a position located 200 mm apart from the tip end Tp to a position located 950 mm apart from the tip end Tp is the tapered portion.

A double-pointed arrow Ls in FIG. 1 shows the length of the shaft 6. This length Ls is measured in the axial direction.

The shaft 6 is formed by winding a plurality of prepreg sheets. In the prepreg sheets, fibers are oriented substantially in one direction. Such a prepreg in which fibers are oriented substantially in one direction is also referred to as a UD prepreg. The term "UD" stands for unidirectional. The prepreg sheets may be made of a prepreg other than UD prepreg. For example, fibers contained in the prepreg sheets may be woven. In the present disclosure, the prepreg sheet(s) is/are also simply referred to as a sheet(s).

Each prepreg sheet contains fibers and a resin. The resin is also referred to as a matrix resin. Carbon fibers and glass fibers are exemplified as the fibers. The matrix resin is typically a thermosetting resin.

Examples of the matrix resin in the prepreg sheet include a thermosetting resin and a thermoplastic resin. From the viewpoint of shaft strength, the matrix resin is preferably a thermosetting resin, and more preferably an epoxy resin.

The shaft 6 is manufactured by a sheet-winding method. In the prepreg, the matrix resin is in a semi-cured state. In the shaft 6, the prepreg sheets are wound and cured. This "cured" means that the semi-cured matrix resin is cured. The curing process is achieved by heating. The manufacturing processes of the shaft 6 includes a heating process. The heating process cures the matrix resin in the prepreg sheets.

Figure 2:
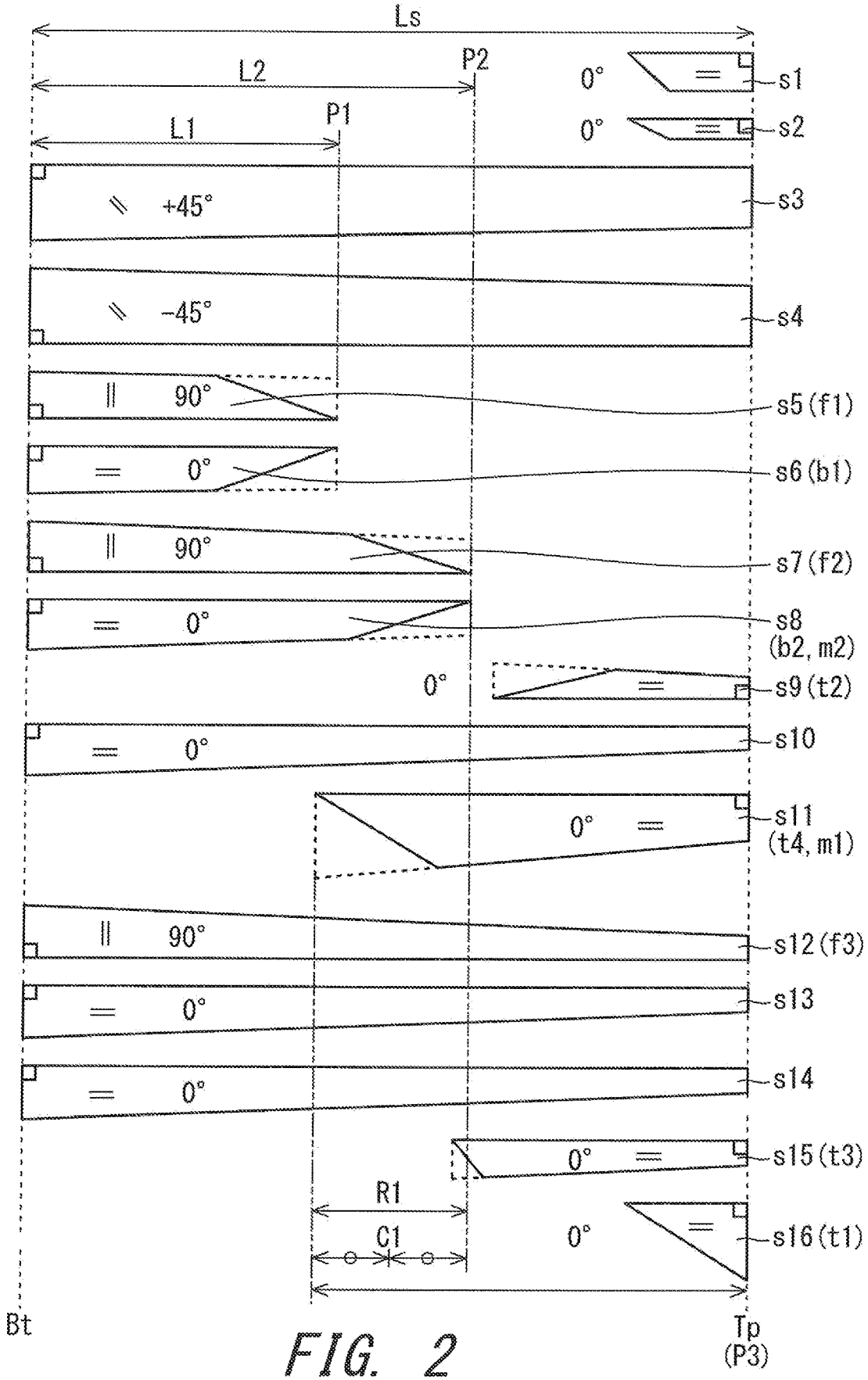
FIG. 2 is a developed view of the golf club shaft in FIG. 1.

FIG. 2 is a developed view of prepreg sheets constituting the shaft 6. FIG. 2 shows the sheets constituting the shaft 6. The shaft 6 is constituted by the plurality of sheets. As shown in FIG. 2, the shaft 6 is constituted by 16 sheets. The shaft 6 includes a first sheet s1 to a sixteenth sheet s16. The developed view shows the sheets constituting the shaft 6 in order from the radial inside of the shaft 6. The sheets are wound in order from the sheet located on the uppermost side in FIG. 2. In FIG. 2, the horizontal direction of the figure coincides with the axial direction of the shaft. In FIG. 2, the right side of the figure is the tip side of the shaft. In FIG. 2, the left side of the figure is the butt side of the shaft.

FIG. 2 shows not only the winding order of the sheets but also the position of each of the sheets in the axial direction. For example, in FIG. 2, an end of the sheet s1 is located at the tip end Tp.

The shaft 6 includes a straight layer, a bias layer, and a hoop layer.

An orientation angle of the fibers (hereinafter referred to as fiber orientation angle) is described for each of the sheets in FIG. 2. A sheet described as "0°" is a straight sheet. The straight sheet forms the straight layer.

The straight layer is a layer in which the fiber orientation angle is substantially set to 0° with respect to the axial direction. Usually, the fiber orientation may not completely be parallel to the shaft axial direction due to an error in winding, for example. In the straight layer, an absolute angle of the fiber orientation angle with respect to the shaft axis line is less than or equal to 10°. The absolute angle means an absolute value of an angle (fiber orientation angle) formed between the shaft axis line and the orientation of fibers. That is, "the absolute angle is less than or equal to 10°" means that "the fiber orientation angle is greater than or equal to −10 degrees and less than or equal to +10 degrees".

In the embodiment of FIG. 2, sheets (straight sheets) that form straight layers are the sheet s1, the sheet s2, the sheet s6, the sheet s8, the sheet s9, the sheet s10, the sheet s11, the sheet s13, the sheet s14, the sheet s15 and the sheet s16. The straight layers make a great contribution to flexural rigidity and flexural strength.

The bias layer is a layer in which the fiber orientation is substantially inclined with respect to the axial direction. The bias layer makes a great contribution to torsional rigidity and torsional strength. Preferably, bias layers are constituted by a pair of two sheets (herein after referred to as a sheet pair) in which fiber orientation angles of the respective sheets are inclined inversely to each other. Preferably, the sheet pair includes: a layer having a fiber orientation angle of greater than or equal to −60° and less than or equal to −30°; and a layer having a fiber orientation angle of greater than or equal to 30° and less than or equal to 60°. That is, the absolute angle in the bias layers is preferably greater than or equal to 30° and less than or equal to 60°.

In the shaft 6, sheets (bias sheets) that form the bias layers are the sheet s3 and the sheet s4. The sheet s3 and the sheet s4 constitute a sheet pair. The sheet pair is wound in a state where the sheet s3 and the sheet s4 are stuck together.

In FIG. 2, the fiber orientation angle is described for each sheet. The plus sign (+) and minus sign (−) used with the fiber orientation angle indicate inclined direction of the fibers. A sheet having a plus fiber orientation angle and a sheet having a minus fiber orientation angle are combined in the sheet pair. In the sheet pair, fibers in respective sheets are inclined inversely to each other. In FIG. 2, the direction of a line showing the direction of the fiber of the sheet s3 is the same as the direction of a line showing the direction of the fiber of the sheet s4. However, the sheet s4 is reversed and then the sheet s3 and the sheet s4 are stuck together. Accordingly, fiber orientation angles of the respective sheets are inclined inversely to each other.

The hoop layer is a layer that is disposed so that the fiber orientation substantially coincides with the circumferential direction of the shaft. Preferably, in the hoop layer, the absolute angle of the fiber orientation angle is substantially set to 90° with respect to the shaft axis line. However, the fiber orientation angle to the shaft axial direction may not be completely set to 90° due to an error in winding, for example. In the hoop layer, the absolute angle of the fiber orientation angle is usually greater than or equal to 80° and less than or equal to 90°.

The hoop layer makes a great contribution to crushing rigidity and crushing strength of a shaft. The crushing rigidity means a rigidity against crushing deformation. The crushing deformation means a deformation caused by a crushing force that is applied to the shaft inward in the radial direction of the shaft. In a typical crushing deformation, the cross section of the shaft is deformed from a circular shape to an elliptical shape. The crushing strength means a strength against the crushing deformation. The crushing strength can relate to the flexural strength. The flexural deformation can involve the crushing deformation. Particularly when a light-weight shaft having a thin wall thickness is used, the flexural deformation is more likely to involve the crushing deformation. Improvement in the crushing strength can contribute to improvement in the flexural strength.

In the embodiment of FIG. 2, prepreg sheets (hoop sheets) that constitute the hoop layers are the sheet s5, the sheet s7 and the sheet s12.

For manufacturing the shaft 6 shown in FIG. 2, a united sheet is used. The united sheet is formed by sticking a plurality of sheets together.

In the embodiment of FIG. 2, four united sheets are used. A first united sheet is the combination of the sheet s3 and the sheet s4. A second united sheet is the combination of the sheet s5 and the sheet s6. A third united sheet is the combination of the sheet s7 and the sheet s8. A fourth united sheet is the combination of the sheet s12 and the sheet s13.

As described above, in the present disclosure, the sheets and the layers are classified by the fiber orientation angle. Furthermore, in the present disclosure, the sheets and the layers are classified by their lengths in the axial direction.

A layer disposed over an entire length in the axial direction of the shaft is referred to as a full length layer. A sheet disposed over an entire length in the axial direction of the shaft is referred to as a full length sheet. A wound full length sheet forms a full length layer. On the other hand, a layer partly disposed in the axial direction of the shaft is referred to as a partial layer. A sheet partly disposed in the axial direction of the shaft is referred to as a partial sheet. A wound partial sheet forms a partial layer.

A layer that is the bias layer and the full length layer is referred to as a full length bias layer. A layer that is the straight layer and the full length layer is referred to as a full length straight layer. A layer that is the hoop layer and the full length layer is referred to as a full length hoop layer.

In the embodiment of FIG. 2, the full length bias layers are formed by the sheet s3 and the sheet s4. The full length straight layers are formed by the sheet s10, the sheet s13, and the sheet s14. The shaft 6 includes the plurality of full length straight layers s10, s13 and s14. The full length hoop layer is formed by the sheet s12.

A layer that is the bias layer and the partial layer is referred to as a partial bias layer. A layer that is the straight layer and the partial layer is referred to as a partial straight layer. A layer that is the hoop layer and the partial layer is referred to as a partial hoop layer.

In the embodiment of FIG. 2, the partial bias layer is not provided. The partial straight layers are formed by the sheet s1, the sheet s2, the sheet s6, the sheet s8, the sheet s9, the sheet s11, the sheet s15 and the sheet s16. The partial hoop layers are formed by the sheet s5 and the sheet s7. The shaft 6 does not include any partial hoop layer other than the sheet s5 and the sheet s7.

The sheet s1, the sheet s2, the sheet s9, the sheet s11, the sheet s15 and the sheet s16 constitute tip partial straight layers. The tip partial straight layers are disposed in the tip portion of the shaft 6. One ends of the respective tip partial straight layers are located at the tip end Tp.

The sheet s6 and the sheet s8 constitute butt partial straight layers. The butt partial straight layers are disposed in the butt portion of the shaft 6. One ends of the respective butt partial straight layers are located at the butt end Bt.

The sheet s5 and the sheet s7 constitute butt partial hoop layers. The butt partial hoop layers are disposed in the butt portion of the shaft 6. One ends of the respective butt partial straight layers are located at the butt end Bt.

Hereinafter, the outline of manufacturing processes of the shaft 6 will be described.

[Outline of Manufacturing Processes of Shaft]

(1) Cutting Process

Prepreg sheets are cut into respective desired shapes in the cutting process. Each of the sheets shown in FIG. 2 is cut out in this process.

The cutting may be performed by a cutting machine or may be manually performed. In the manual case, a cutter knife is used, for example.

(2) Sticking Process

In the sticking process, each united sheet described above is produced by sticking a plurality of sheets together. In the sticking process, heating and/or pressing step(s) may be carried out.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheets are wound around the mandrel. The tacking resin facilitates the application of the end part of a sheet to the mandrel.

A wound body is obtained in the winding process. The wound body is obtained by winding the prepreg sheets around the outside of the mandrel. For example, the winding is achieved by rolling the object to be wound on a plane. The winding may be manually performed or may be performed by a machine. The machine is referred to as a rolling machine.

(4) Tape Wrapping Process

A tape is wrapped around the outer circumferential surface of the wound body in the tape wrapping process. The tape is also referred to as a wrapping tape. The wrapping tape is helically wrapped while tension is applied to the tape so that there is no gap between adjacent windings. The wrapping tape applies pressure to the wound body. The pressure contributes to reduction of voids.

(5) Curing Process

In the curing process, the wound body after being subjected to the tape wrapping is heated. The heating cures the matrix resin. In the curing process, the matrix resin fluidizes temporarily. The fluidization of the matrix resin can discharge air from between the sheets or in each sheet. The fastening force of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is preferably performed after the process of extracting the mandrel.

(7) Process of Cutting Off Both Ends

Both end portions of the cured laminate are cut off in the process. The cutting off flattens the end face of the tip end Tp and the end face of the butt end Bt.

(8) Polishing Process

The surface of the cured laminate is polished in the process. Spiral unevenness is present on the surface of the cured laminate as the trace of the wrapping tape. The polishing removes the unevenness to smooth the surface of the cured laminate.

(9) Coating Process

The cured laminate after the polishing process is subjected to coating.

A forward flex and a backward flex are measured in the shaft 6. The forward flex and the backward flex are specifications relating to the flexural rigidity of the shaft 6.

Figure 3A:
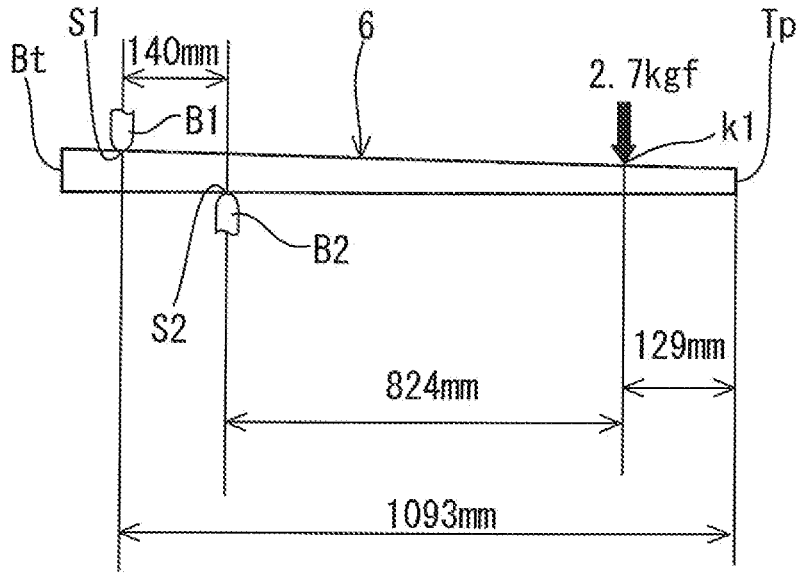
FIG. 3A is a schematic diagram illustrating a method for measuring a forward flex.

FIG. 3A illustrates a method for measuring the forward flex. As shown in FIG. 3A, a first support point S1 is set at a position spaced 1093 mm apart from the tip end Tp. Further, a second support point S2 is set at a position spaced 953 mm apart from the tip end Tp. A support B1 that supports the shaft 6 from above is provided at the first support point S1. A support B2 for supporting the shaft 6 from below is provided at the second support point S2. The shaft axis line of the shaft 6 extends horizontally in the state where no load is applied to the shaft 6. At a load point k1 that is spaced 129 mm apart from the tip end Tp, a load of 2.7 kgf is applied vertically downward. The forward flex is the distance (mm) between the load point k1 in the state where no load is applied and the load point k1 in the state where the shaft is stabilized under application of the load. This distance is measured in the vertical direction.

Of the support B1, a portion to be in contact with the shaft (hereinafter referred to as "contact portion") has a cross-sectional shape as described below. When viewed in a cross section parallel to the shaft axial direction, the cross-sectional shape of the contact portion of the support B1 has convex roundness. The radius of curvature of this roundness is 15 mm. When viewed in a cross section perpendicular to the shaft axial direction, the cross-sectional shape of the contact portion of the support B1 has concave roundness. The radius of curvature of this concave roundness is 40 mm. When viewed in the cross section perpendicular to the shaft axial direction, the length of the contact portion of the support B1 in the horizontal direction (the length in the depth direction of the figure in FIG. 3A) is 15 mm. The contact portion of the support B2 has the same cross-sectional shape as the contact portion of the support B1. The cross-sectional shape of the contact portion of a load indenter (not shown) applying the load of 2.7 kgf at the load point k1 has convex roundness when viewed in the cross section parallel to the shaft axial direction. The radius of curvature of this roundness is 10 mm. The cross-sectional shape of the contact portion of the load indenter (not shown) applying the load of 2.7 kgf at the load point k1 is a straight line when viewed in the cross section perpendicular to the shaft axial direction. This straight line has a length of 18 mm. A weight including the load indenter is suspended at the load point k1.

Figure 3B:
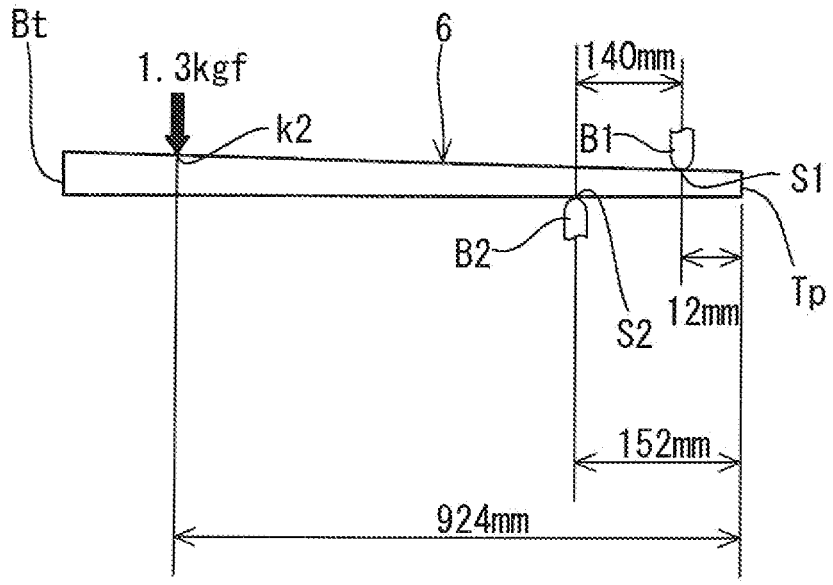
FIG. 3B is a schematic diagram illustrating a method for measuring a backward flex.

FIG. 3B illustrates a method for measuring the backward flex. The method for measuring the backward flex is the same as the above-described method for measuring the forward flex, except that the first support point S1 is set at a position spaced 12 mm apart from the tip end Tp, the second support point S2 is set at a position spaced 152 mm apart from the tip end Tp, a load point k2 is set at a position spaced 924 mm apart from the tip end Tp, and the load is set to 1.3 kgf.

A shaft torque is measured in the shaft 6. The shaft torque means a torsion angle formed when a predetermined torque is applied to the shaft 6. Accordingly, the smaller the shaft torque is, the greater the torsional rigidity of the shaft 6 is.

Figure 4:
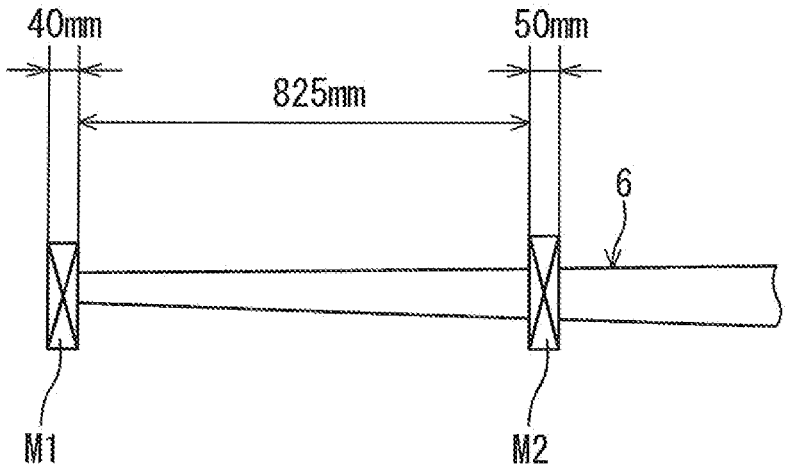
FIG. 4 is a schematic diagram illustrating a method for measuring a shaft torque.

FIG. 4 is a schematic diagram showing a method for measuring the shaft torque. A portion between the tip end Tp and a point located 40 mm apart from the tip end Tp is fixed by a jig M1. This fixing is achieved by an air chuck, and the air pressure of the air chuck is 2.0 kgf/cm$^2$. A jig M2 is fixed to a portion extending from a position located 825 mm apart from the jig Ml toward the butt end Bt and having a width of 50 mm. This fixing is achieved by an air chuck, and the air pressure of this air chuck is 1.5 kgf/cm$^2$. The jig M2 is rotated while the jig M1 is fixed, and a torque of 0.139 kgf·m is applied to the shaft 6. A torsion angle (°) caused by this torque is the shaft torque. The smaller the shaft torque is, the greater the torsional rigidity of the shaft 6 is.

A three-point flexural strength is measured in the shaft 6. This strength can be measured by a three-point flexural strength test in accordance with SG standards. This test is a test (CPSA0098) for golf club shafts stipulated by Consumer Product Safety Association in JAPAN. Each strength at a point T, a point A, a point B, and a point C is measured in this test. The point T is a position located 90 mm apart from the tip end Tp. The point A is a position located 175 mm apart from the tip end Tp. The point B is located 525 mm apart from the tip end Tp. The point C is located 175 mm apart from the butt end Bt.

An impact absorbing energy of the tip portion is measured in the shaft 6. The impact absorbing energy shows a strength against an impact when hitting a ball.

Figure 5:
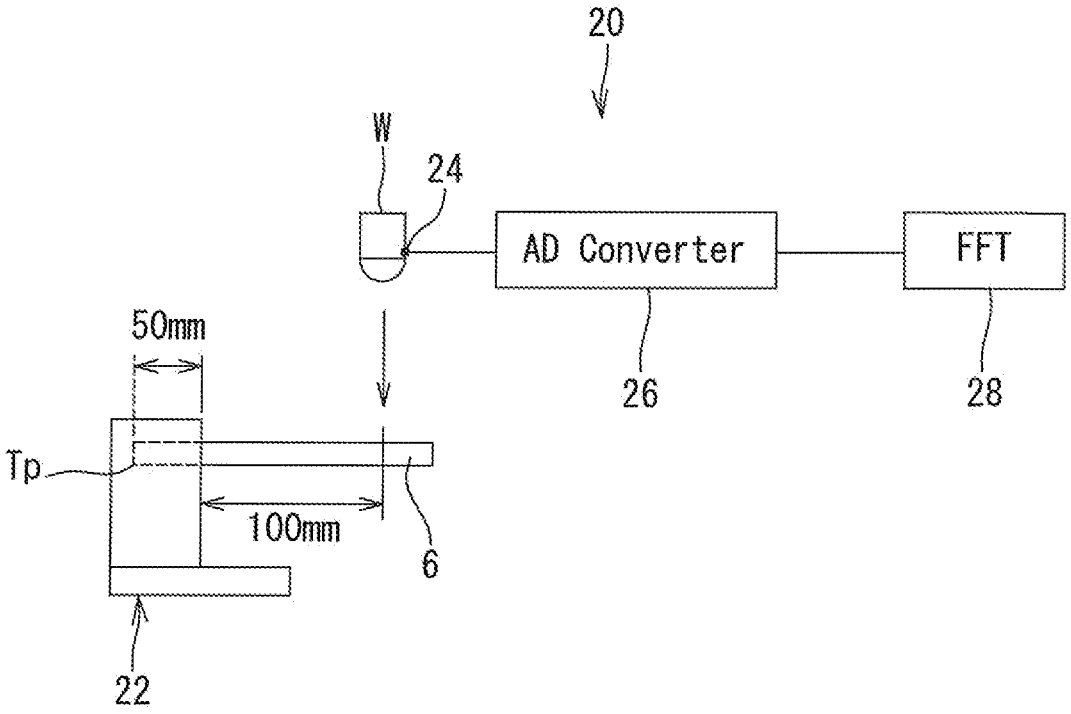
FIG. 5 is a schematic diagram illustrating a method for measuring an impact absorbing energy.

FIG. 5 shows a method for measuring the impact absorbing energy of the tip portion. A tip portion of a shaft obtained by cutting a shaft at a position located 200 mm apart from the tip end Tp is used in this measurement. This measurement is an impact test performed by a cantilever bending method. As a measuring device 20, a falling weight impact tester (IITM-18) manufactured by YONEKURA MFG. Co., Ltd. is used. Of the cut shaft, a tip portion extending from the tip end Tp to a point located 50 mm apart from the tip end Tp is fixed by a fixing jig 22. A weight body W having a weight of 600 g is collided at a point located 100 mm apart from the end of the fixed portion, that is, at a point located 150 mm apart from the tip end Tp. The weight body W is collided at the point by falling the weight body W from 1500 mm above the shaft 6. An accelerometer 24 is attached to the weight body W. The accelerometer 24 is connected to an FFT analyzer 28 via AD converter 26. A measured waveform is obtained by FFT processing. By this measurement, a displacement D and an impact bending load L are measured, and the value of impact absorbing energy until fracture starts is calculated.

Figure 6:
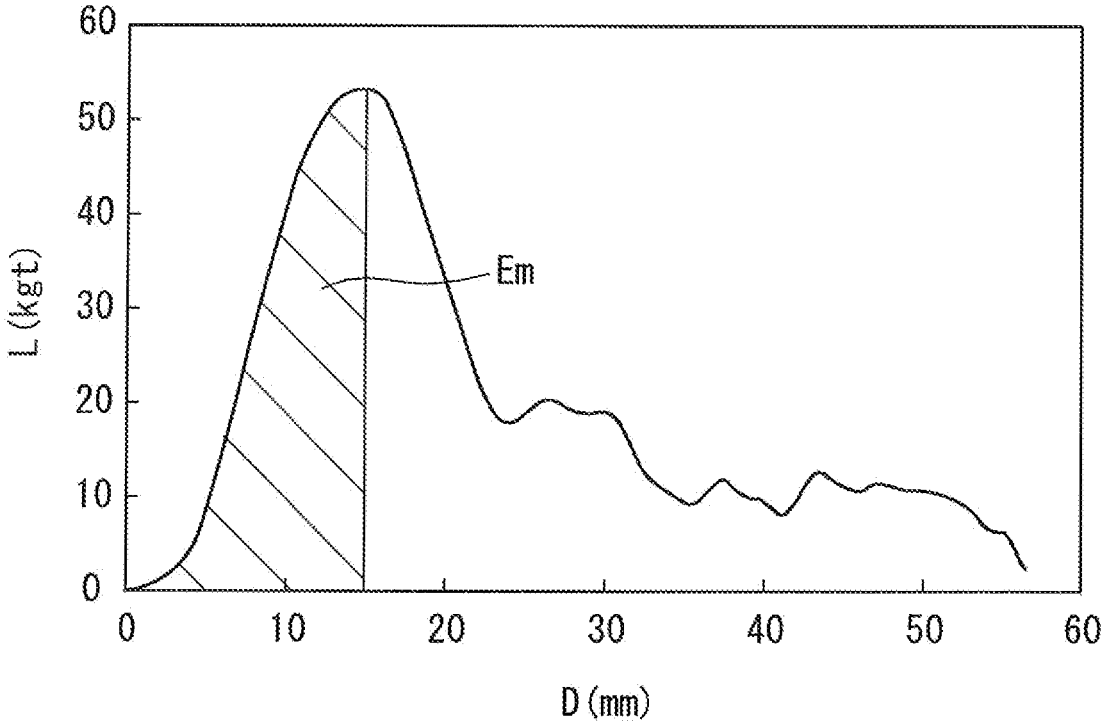
FIG. 6 is a graph showing an example of waveform obtained in measurement of an impact absorbing energy.

FIG. 6 shows an example of the measured waveform. This waveform is a graph showing a relationship between the displacement D (mm) and the impact bending load L (kgf). In this graph of FIG. 6, an area of a portion indicated with hatching is the impact absorbing energy Em (J).

Figure 7:
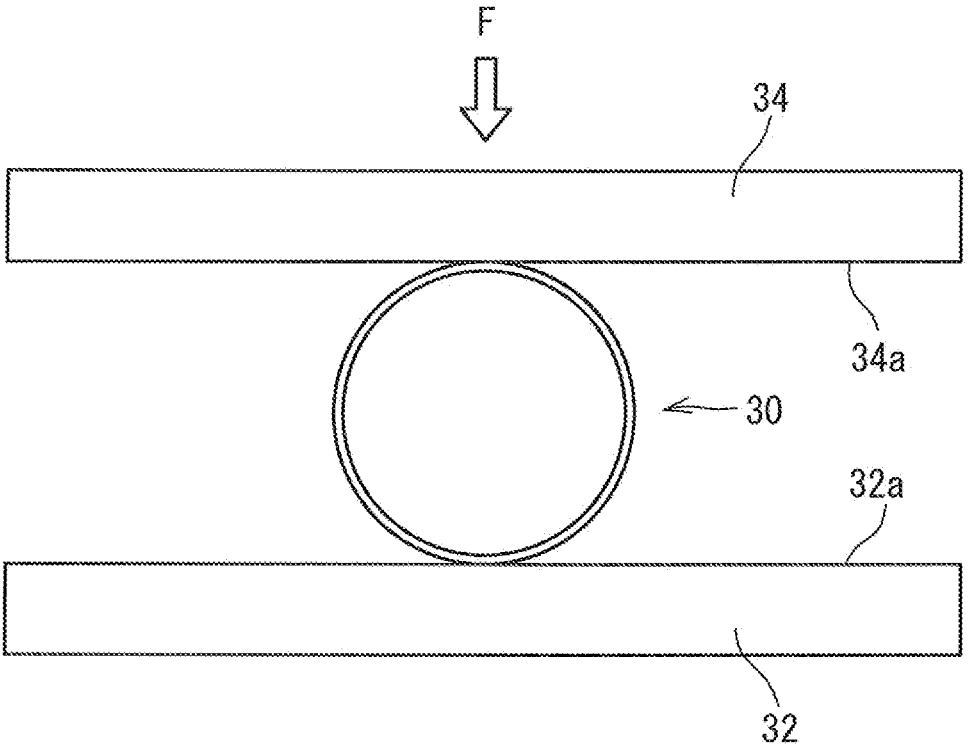
FIG. 7 is a schematic diagram illustrating a method for measuring a crushing strength.

In the shaft 6, a crushing strength is measured. FIG. 7 shows a method for measuring the crushing strength. For this measurement, a universal testing machine (model 220X) produced by Intesco Co., Ltd. is used. A sample 30 that has a point to be measured at its center in the axial direction and has a width in the axial direction of 10 mm is cut out from the shaft 6. The sample 30 is placed on a horizontal plane that is an upper surface 32*a* of a receiving jig 32, and the the sample 30 is compressed by a compressing jig 34. The compressing jig 34 is moved vertically downwards to compress the sample 30, and a load applied when a complete fracture occurs is measured. The sample 30 is compressed so that the sample 30 is subjected to crushing deformation. A lower surface 34*a* that is the lower surface of the compressing jig 34 and that presses the sample 30 is a plane parallel to the upper surface 32*a* of the receiving jig 32. The descending speed of the compressing jig 34 is 5 mm/min.

The shaft 6 gives a good feeling to athlete-type golfers and is easy to swing for such golfers while being lightweight. For this reason, the shaft 6 can be used by athlete-type golfers who have avoided using a lightweight shaft so far. When athlete-type golfers having relatively high physical strength uses a lightweight shaft, the head speed of their swing can be greatly improved. The athlete-type golfers in the present disclosure mean golfers who swing a driver at a head speed of about 40 to 48 m/s.

The shaft 6 is lightweight. Weight reduction of a shaft leads to increase in head speed. From this viewpoint, the shaft weight is preferably less than or equal to 50 g, more preferably less than or equal to 49 g, and still more preferably less than or equal to 48 g. From the viewpoint of strength, the shaft weight is preferably greater than or equal to 30 g, more preferably greater than or equal to 32 g, and still more preferably greater than or equal to 34 g. The shaft weight of Example 1 described below was 47 g.

From the viewpoint of not causing athlete-type golfers to feel a sense of incongruity and giving a good feeling to such golfers, the forward flex is preferably less than or equal to 110 mm, more preferably less than or equal to 108 mm, and still more preferably less than or equal to 106 mm. From the viewpoint of increasing head speed by recovery from bending, the forward flex is preferably greater than or equal to 80 mm, more preferably greater than or equal to 85 mm, and still more preferably greater than or equal to 90 mm. The forward flex of Example 1 described below was 105 mm.

From the viewpoint of not causing athlete-type golfers to feel a sense of incongruity and giving a good feeling to such golfers, the backward flex is preferably less than or equal to 100 mm, more preferably less than or equal to 98 mm, and still more preferably less than or equal to 96 mm. From the viewpoint of increasing head speed by recovery from bending, the backward flex is preferably greater than or equal to 70 mm, more preferably greater than or equal to 75 mm, and still more preferably greater than or equal to 80 mm. The backward flex of Example 1 described below was 95 mm.

It should be noted that the recovery from bending means that bent shaft returns to an unbent state after the shaft is bent such that the head delays with respect to the travel direction of a swing. The recovery from bending in downswing increases head speed.

From the viewpoint of not causing athlete-type golfers to feel a sense of incongruity and giving a good feeling to such golfers, the shaft torque is preferably less than or equal to 6.5°, more preferably less than or equal to 6.4°, and still more preferably less than or equal to 6.3°. A lightweight shaft limits the amount of material used for the shaft. From this viewpoint, the shaft torque is preferably greater than or equal to 4.0°, more preferably greater than or equal to 4.1°, and still more preferably greater than or equal to 4.2°. The shaft torque of Example 1 described below was 6.2°.

A high strength is required for a shaft used by athlete-type golfers. From this viewpoint, the three-point flexural strength at the point T (the point located 90 mm apart from the tip end Tp) is preferably greater than or equal to 190 kgf, more preferably greater than or equal to 195 kgf, and still more preferably greater than or equal to 200 kgf. A lightweight shaft limits the amount of material used for the shaft. From this viewpoint, the three-point flexural strength at the point T is preferably less than or equal to 220 kgf, more preferably less than or equal to 215 kgf, and still more preferably less than or equal to 210 kgf.

A high strength is required for a shaft used by athlete-type golfers. From this viewpoint, the three-point flexural strength at the point A (the point located 175 mm apart from the tip end Tp) is preferably greater than or equal to 70 kgf, more preferably greater than or equal to 73 kgf, and still more preferably greater than or equal to 75 kgf. A lightweight shaft limits the amount of material used for the shaft. From this viewpoint, the three-point flexural strength at the point A is preferably less than or equal to 85 kgf, more preferably less than or equal to 83 kgf, and still more preferably less than or equal to 80 kgf.

A high strength is required for a shaft used by athlete-type golfers. From this viewpoint, the three-point flexural strength at the point B (the point located 525 mm apart from the tip end Tp) is preferably greater than or equal to 65 kgf, more preferably greater than or equal to 68 kgf, and still more preferably greater than or equal to 70 kgf. A lightweight shaft limits the amount of material used for the shaft. From this viewpoint, the three-point flexural strength at the point B is preferably less than or equal to 80 kgf, more preferably less than or equal to 78 kgf, and still more preferably less than or equal to 75 kgf.

A high strength is required for a shaft used by athlete-type golfers. From this viewpoint, the three-point flexural strength at the point C (the point located 175 mm apart from the butt end Bt) is preferably greater than or equal to 90 kgf, more preferably greater than or equal to 95 kgf, and still more preferably greater than or equal to 100 kgf. A lightweight shaft limits the amount of material used for the shaft. From this viewpoint, the three-point flexural strength at the point C is preferably less than or equal to 120 kgf, more preferably less than or equal to 115 kgf, and still more preferably less than or equal to 110 kgf.

When an athlete-type golfer hits a ball with a golf club, a strong impact is applied on the tip portion of the shaft. From this viewpoint, the impact absorbing energy of the tip portion is preferably greater than or equal to 3.4 J, more preferably greater than or equal to 3.5 J, and still more preferably greater than or equal to 3.6 J. A lightweight shaft limits the amount of material used for the shaft. From this viewpoint, the impact absorbing energy of the tip portion is preferably less than or equal to 4.0 J, more preferably less than or equal to 3.9 J, and still more preferably less than or equal to 3.8 J.

From the viewpoints of solid feel and strength, the crushing strength at a position located 550 mm apart from the tip end Tp is preferably greater than or equal to 11 kgf, more preferably greater than or equal to 17 kgf, and still more preferably greater than or equal to 18 kgf. A lightweight shaft limits the amount of material used for the shaft. From this viewpoint, the crushing strength at the position located 550 mm apart from the tip end Tp is preferably less than or equal to 26 kgf, more preferably less than or equal to 25 kgf, and still more preferably less than or equal to 24 kgf.

From the viewpoints of solid feel and strength, the crushing strength at a position located 650 mm apart from the tip end Tp is preferably greater than or equal to 11 kgf, more preferably greater than or equal to 16 kgf, and still more preferably greater than or equal to 17 kgf. A lightweight shaft limits the amount of material used for the shaft. From this viewpoint, the crushing strength at the position located 650 mm apart from the tip end Tp is preferably less than or equal to 24 kgf, more preferably less than or equal to 23 kgf, and still more preferably less than or equal to 22 kgf.

From the viewpoints of solid feel and strength, the crushing strength at a position located 750 mm apart from the tip end Tp is preferably greater than or equal to 11 kgf, more preferably greater than or equal to 15 kgf, and still more preferably greater than or equal to 16 kgf. A lightweight shaft limits the amount of material used for the shaft. From this viewpoint, the crushing strength at the position located 750 mm apart from the tip end Tp is preferably less than or equal to 22 kgf, more preferably less than or equal to 21 kgf, and still more preferably less than or equal to 20 kgf.

From the viewpoints of solid feel and strength, the crushing strength at a position located 850 mm apart from the tip end Tp is preferably greater than or equal to 11 kgf, more preferably greater than or equal to 14 kgf, and still more preferably greater than or equal to 15 kgf. A lightweight shaft limits the amount of material used for the shaft. From this viewpoint, the crushing strength at the position located 850 mm apart from the tip end Tp is preferably less than or equal to 20 kgf, more preferably less than or equal to 19 kgf, and still more preferably less than or equal to 18 kgf.

From the viewpoints of solid feel and strength, the crushing strength at a position located 950 mm apart from the tip end Tp is preferably greater than or equal to 11 kgf, more preferably greater than or equal to 13 kgf, and still more preferably greater than or equal to 14 kgf. A lightweight shaft limits the amount of material used for the shaft. From this viewpoint, the crushing strength at the position located 950 mm apart from the tip end Tp is preferably less than or equal to 19 kgf, more preferably less than or equal to 18 kgf, and still more preferably less than or equal to 17 kgf.

With reference to FIG. 2, the shaft 6 includes: a first hoop layer f1 that is disposed from the butt end Bt to a first position P1; a second hoop layer f2 that is longer than the first hoop layer f1 and is disposed from the butt end Bt to a second position P2; and a third hoop layer f3 that is longer than the second hoop layer f2 and is disposed from the butt end Bt to a third position P3. The second position P2 is located on the tip side with respect to the first position P1. The third position P3 is located on the tip side with respect to the second position P2. In the present embodiment, the first hoop layer f1 is the layer s5, the second hoop layer f2 is the layer s7, and the third hoop layer f3 is the layer s12.

In the present embodiment, the third position P3 is the tip end Tp, and thus the third hoop layer f3 is the full length hoop layer. Alternatively, the third hoop layer f3 may be a partial hoop layer. When the third hoop layer f3 is a partial hoop layer, the length of the third hoop layer f3 is preferably greater than or equal to 900 mm, more preferably greater than or equal to 950 mm, and still more preferably greater than or equal to 1000 mm, and is preferably less than or equal to 1150 mm, more preferably less than or equal to 1140 mm, and still more preferably less than or equal to 1130 mm. The first hoop layer f1 and the second hoop layer f2 are butt partial hoop layers.

It has been found that the use of the three hoop layers f1, f2 and f3 having respective lengths different from each other is effective for athlete-type golfers. It has been found that athlete-type golfers feel that a shaft in which a portion close to the grip is solidly formed is easy to swing. In a lightweight shaft having a thin wall thickness, a portion having a large outer diameter tends to be subjected to crushing deformation. By the use of the three hoop layers f1, f2 and f3 having respective lengths different from each other, the crushing rigidity is further reinforced as the position of the shaft becomes closer to the butt end where the outer diameter of the shaft is larger. As a result, this shaft provides a solid feel while being lightweight, which gives an improved feeling to athlete-type golfers.

As the position of the hoop layer is on the more outer side, the hoop layer more effectively improves the crushing rigidity. A longer hoop layer disposed on the outer side can maximize the advantageous effect of the hoop layer on the crushing rigidity in the whole shaft 6. This contributes to weight reduction of the shaft 6.

The second hoop layer f2 is disposed on the outer side than the first hoop layer f1. Accordingly, the tip-side end of the first hoop layer f1 is covered with the second hoop layer f2. The third hoop layer f3 is disposed on the outer side than the second hoop layer f2. Accordingly, the tip-side end of the second hoop layer f2 is covered with the third hoop layer f3. These configurations can stabilize crushing deformation that occurs at the end positions of the partial hoop layers, and can improve feeling.

The first hoop layer f1 and/or the second hoop layer f2 is thicker than the third hoop layer f3. This reinforces the crushing rigidity of the butt portion having a larger outer diameter, and can further improve the solid feel. In the shaft 6, the second hoop layer f2 is thicker than the third hoop layer f3. In the shaft 6, the second hoop layer f2 is thicker than the first hoop layer f1. In the shaft 6, the first hoop layer f1 is thinner than the third hoop layer f3. Alternatively, the first hoop layer f1 may be thicker than the third hoop layer f3. From the viewpoint of the solid feel, the second hoop layer f2 is preferably thicker than the third hoop layer f3.

From the viewpoint of the shaft weight, the thickness of the first hoop layer f1 is preferably less than or equal to 0.035 mm, more preferably less than or equal to 0.034 mm, and still more preferably less than or equal to 0.033 mm. From the viewpoint of the crushing strength of the butt portion of the shaft 6, the thickness of the first hoop layer f1 is preferably greater than or equal to 0.020 mm, more preferably greater than or equal to 0.021 mm, and still more preferably greater than or equal to 0.022 mm.

From the viewpoint of the shaft weight, the thickness of the second hoop layer f2 is preferably less than or equal to 0.045 mm, more preferably less than or equal to 0.040 mm, and still more preferably less than or equal to 0.035 mm. From the viewpoint of the solid feel, the thickness of the second hoop layer f2 is preferably greater than or equal to 0.028 mm, more preferably greater than or equal to 0.030 mm, and still more preferably greater than or equal to 0.032 mm.

From the viewpoint of the shaft weight, the thickness of the third hoop layer f3 is preferably less than or equal to 0.030 mm, more preferably less than or equal to 0.029 mm, and still more preferably less than or equal to 0.028 mm. From the viewpoints of the crushing strength and the solid feel, the thickness of the third hoop layer f3 is preferably greater than or equal to 0.020 mm, more preferably greater than or equal to 0.021 mm, and still more preferably greater than or equal to 0.022 mm.

A double-pointed arrow L1 in FIG. 2 shows the length of the first hoop layer f1. From the viewpoint of reinforcing the hand-gripped portion of the shaft 6 to improve the solid feel, the length L1 of the first hoop layer f1 is preferably greater than or equal to 300 mm, more preferably greater than or equal to 350 mm, and still more preferably greater than or equal to 400 mm. From the viewpoint of selectively reinforcing a region located on the butt side, the length L1 of the first hoop layer f1 is preferably less than or equal to 550 mm, more preferably less than or equal to 540 mm, and still more preferably less than or equal to 530 mm.

A double-pointed arrow L2 in FIG. 2 shows the length of the second hoop layer f2. From the viewpoint of making the second hoop layer f2 longer than the first hoop layer f1 to enhance the solid feel, the length L2 of the second hoop layer f2 is preferably greater than or equal to 500 mm, more preferably greater than or equal to 550 mm, and still more preferably greater than or equal to 600 mm. From the viewpoint of weight reduction of the shaft 6, the length L2 of the second hoop layer f2 is preferably less than or equal to 775 mm, more preferably less than or equal to 765 mm, and still more preferably less than or equal to 755 mm.

The shaft 6 includes a low elastic tip partial layer that has a fiber elastic modulus of less than or equal to 10 t/mm$^2$. In FIG. 2, the low elastic tip partial layer is the tip partial straight layer s1. The presence of the low elastic tip partial layer s1 increases the impact absorbing energy of the tip portion of the shaft 6. The low elastic tip partial layer s1 is a glass fiber reinforced layer that is reinforced with glass fibers. For this reason, the impact absorbing energy is further enhanced. The shaft 6 includes a thick wall portion in which two or more plies of the low elastic tip partial layer sl are wound. The length of the thick wall portion is greater than or equal to 100 mm (and less than or equal to 250 mm). The thick wall portion further increases the impact absorbing energy.

The butt partial straight layers include a first butt straight layer b1 that has a first length, and a second butt straight layer b2 that has a second length. The second butt straight layer b2 is longer than the first butt straight layer b1. In the embodiment of FIG. 2, the first butt straight layer bl is the layer s6, and the second butt straight layer b2 is the layer s8. The first butt straight layer b1 is in contact with the first hoop layer f1. The second butt straight layer b2 is in contact with the second hoop layer f2. The second butt straight layer b2 is located on the outer side than the first butt straight layer b1.

By the use of the first butt straight layer bl and the second butt straight layer b2 different from each other, the flexural rigidity is further reinforced as the position of the shaft becomes closer to the butt end where the outer diameter of the shaft is larger. As a result, this shaft provides a solid feel while being lightweight, which gives an improved feeling to athlete-type golfers. The synergistic effect of this advantageous effect and the hoop layers f1 to f3 improves feeling.

The preferable range of the length of the first butt straight layer b1 is the same as that of the length L1 of the first hoop layer f1. The preferable range of the length of the second butt straight layer b2 is the same as that of the length L2 of the second hoop layer f2.

The shaft 6 includes the plurality of butt partial straight layers s6 and s8. Of these butt partial straight layers, a butt partial straight layer that has the longest length is also referred to as a longest butt straight layer. In the present embodiment, the longest butt straight layer m2 is the layer s8. In the present embodiment, the longest butt straight layer m2 is the second butt straight layer b2.

The tip partial straight layers include a first tip straight layer t1 that has a first length, a second tip straight layer t2 that has a second length, a third tip straight layer t3 that has a third length, and a fourth tip straight layer t4 that has a fourth length. In the embodiment of FIG. 2, the second tip straight layer t2 is longer than the first tip straight layer t1. The third tip straight layer t3 is longer than the second tip straight layer t2. The fourth tip straight layer t4 is longer than the third tip straight layer t3.

In the embodiment of FIG. 2, the first tip straight layer t1 is the layer s16, the second tip straight layer t2 is the layer s9, the third tip straight layer t3 is the layer s15, and the fourth tip straight layer t4 is the layer s11. Alternatively, the layer s1 or the layer s2 may be the first tip straight layer t1.

By reducing the number of the full length straight layers and increasing the number of the partial straight layers, the amount of prepregs can be reduced and the shaft weight can be suppressed. At the ends of a partial straight layer, however, stress may be concentrated when the shaft is subjected to flexural deformation. By varying the positions of the ends of the tip straight layers and also varying the lengths of the tip straight layers, the positions of the ends of the tip straight layers are dispersed in the axial direction. In addition, the strength of the shaft can be further increased as the position of the shaft becomes closer to the tip end which is positioned near the head and at which a sufficient flexural strength is required. Accordingly, the strength can be improved.

The first tip straight layer t1 is located on the outer side than the fourth tip straight layer t4. The second tip straight layer t2 is located on the inner side than the fourth tip straight layer t4. The third tip straight layer t3 is located on the outer side than the fourth tip straight layer t4.

At least one selected from the group consisting of the first tip straight layer t1, the second tip straight layer t2, the third tip straight layer t3, and any combination thereof is located on the inner side than the fourth tip straight layer t4. At least one selected from the group consisting of the first tip straight layer t1, the second tip straight layer t2, the third tip straight layer t3, and any combination thereof is located on the outer side than the fourth tip straight layer t4. With this configuration, the positions of the ends of the tip straight layers are dispersed in the radial direction. Accordingly, the strength can be improved.

In the shaft 6, the plurality of tip partial straight layers are provided. Of the tip partial straight layers, a tip partial straight layer that has the longest length is also referred to as a longest tip straight layer. In the embodiment of FIG. 2, the longest tip straight layer m1 is the layer s11. The longest tip straight layer m1 is the fourth tip straight layer t4.

The shaft 6 includes an overlapping portion R1 in which the longest tip straight layer m1 overlaps the second butt straight layer b2 in the axial direction (see FIG. 2). The overlapping portion R1 is formed by the longest tip straight layer m1 and the longest butt straight layer m2 overlapping each other in the axial direction.

The overlapping portion R1 is located at a middle position of the shaft 6. The middle portion is subjected to a large flexural deformation when the shaft 6 bends during swing. The overlapping portion R1 increases the flexural rigidity of the middle portion of the shaft 6. The overlapping portion R1 increases the rigidity of a portion that is easy to bend. The overlapping portion R1 enhances the solid feel and contributes to the improvement of feeling.

The second hoop layer f2 is disposed in at least a part of the overlapping portion R1. This can further enhance the solid feel and shaft feeling. In the present embodiment, the second hoop layer f2 is disposed over the entire length of the overlapping portion R1 (see FIG. 2).

From the viewpoint of the solid feel for athlete-type golfers, the length of the overlapping portion R1 is preferably greater than or equal to 100 mm, more preferably greater than or equal to 150 mm, and still more preferably greater than or equal to 200 mm. From the viewpoint of weight reduction of the shaft 6, the length of the overlapping portion R1 is preferably less than or equal to 400 mm, more preferably less than or equal to 350 mm, and still more preferably less than or equal to 300 mm.

The overlapping portion R1 has a center C1 in the axial direction (see FIG. 2). From the viewpoint of the solid feel for athlete-type golfers, the center C1 in the axial direction of the overlapping portion R1 is preferably located between the first position P1 and the second position P2.

An outer diameter of the shaft 6 at the position located 550 mm apart from the tip end Tp is denoted by D5 (mm). An outer diameter of the shaft 6 at the position located 950 mm apart from the tip end Tp is denoted by D9 (mm). A crushing strength at the position located 550 mm apart from the tip end Tp is denoted by F5 (kgf). A crushing strength at the position located 950 mm apart from the tip end Tp is denoted by F9 (kgf).

When a ratio F5/D5 is small, the crushing strength is small relative to the outer diameter, which leads to an insufficient solid feel and deterioration in shaft feeling. From this viewpoint, F5/D5 is preferably greater than or equal to 1.5, more preferably greater than or equal to 1.55, and still more preferably greater than or equal to 1.6. When F5/D5 is large, the crushing strength is large relative to the outer diameter. In this case, while there is room for reduction in the amount of the hoop layers, the amount of layers other than the hoop layers can be insufficient, which can lead to deterioration in shaft feeling. From this viewpoint, F5/D5 is preferably less than or equal to 2.5, more preferably less than or equal to 2.4, and still more preferably less than or equal to 2.3.

When a ratio F9/D9 is small, the crushing strength is small relative to the outer diameter, which leads to an insufficient solid feel and deterioration in shaft feeling. From this viewpoint, F9/D9 is preferably greater than or equal to 1.0, more preferably greater than or equal to 1.05, still more preferably greater than or equal to 1.08, and yet still more preferably greater than or equal to 1.1. When F9/D9 is large, the crushing strength is large relative to the outer diameter. In this case, while there is room for reduction in the amount of the hoop layers, the amount of layers other than the hoop layers can be insufficient, which can lead to deterioration in shaft feeling. From this viewpoint, F9/D9 is preferably less than or equal to 2.0, more preferably less than or equal to 1.9, and still more preferably less than or equal to 1.8.

When a difference (F5–F9) is large, the crushing strength on the butt side is relatively small, which can lead to an insufficient solid feel. From this viewpoint, the difference (F5–F9) is preferably less than or equal to 4 kgf, more preferably less than or equal to 3.9 kgf, still more preferably less than or equal to 3.8 kgf, and yet still more preferably less than or equal to 3.5 kgf. Considering the limit of the degree of freedom of design, the difference (F5–F9) is preferably greater than or equal to 1.0 kgf, more preferably greater than or equal to 1.5 kgf, and still more preferably greater than or equal to 2.0 kgf.

From the viewpoint of flight distance, the length Ls of the shaft is preferably greater than or equal to 1080 mm, more preferably greater than or equal to 1130 mm, and still more preferably greater than or equal to 1150 mm. Considering restriction on the club length under the rules of golf, the length Ls of the shaft is preferably less than or equal to 1210 mm, more preferably less than or equal to 1200 mm, and still more preferably less than or equal to 1190 mm.

From the viewpoint of increasing the head speed, the shaft weight is preferably less than or equal to 50 g, more preferably less than or equal to 49 g, and still more preferably less than or equal to 48 g. From the viewpoint of the degree of freedom of design, the shaft weight is preferably greater than or equal to 30 g, more preferably greater than or equal to 32 g, and still more preferably greater than or equal to 34 g.

The following tables show examples of prepregs utilizable in the shaft of the present disclosure.

TABLE 1

Examples of utilizable prepregs

| | | | Weight | | | Physical property value of reinforcing fiber | | |
|---|---|---|---|---|---|---|---|---|
| Manufacturer | Trade name | Thickness of sheet (mm) | per unit area (g/m$^2$) | Fiber content (% by weight) | Resin content (% by weight) | Part number of fiber | Tensile elastic modulus (t/mm$^2$) | Tensile strength (kgf/mm$^2$) |
| Toray Industries, Inc. | 3255S-10 | 0.082 | 132 | 76 | 24 | T700S | 24 | 500 |
| Toray Industries, Inc. | 3255S-12 | 0.103 | 165 | 76 | 24 | T700S | 24 | 500 |
| Toray Industries, Inc. | 3255S-15 | 0.123 | 198 | 76 | 24 | T700S | 24 | 500 |
| Toray Industries, Inc. | 2255S-10 | 0.082 | 132 | 76 | 24 | T800S | 30 | 600 |
| Toray Industries, Inc. | 2255S-12 | 0.102 | 164 | 76 | 24 | T800S | 30 | 600 |
| Toray Industries, Inc. | 2255S-15 | 0.123 | 197 | 76 | 24 | T800S | 30 | 600 |
| Toray Industries, Inc. | 2256S-10 | 0.077 | 125 | 80 | 20 | T800S | 30 | 600 |
| Toray Industries, Inc. | 2256S-12 | 0.103 | 156 | 80 | 20 | T800S | 30 | 600 |
| Toray Industries, Inc. | 2276S-10 | 0.077 | 125 | 80 | 20 | T800S | 30 | 600 |
| Toray Industries, Inc. | 805S-3 | 0.034 | 50 | 60 | 40 | M30S | 30 | 560 |
| Toray Industries, Inc. | 8053S-3 | 0.028 | 43 | 70 | 30 | M30S | 30 | 560 |
| Toray Industries, Inc. | 8053S-3A | 0.023 | 36 | 70 | 30 | M30S | 30 | 560 |
| Toray Industries, Inc. | 1704EG-7 TC | 0.055 | 92 | 82 | 18 | T1100G | 33 | 675 |
| Toray Industries, Inc. | 1704EG-10TC | 0.073 | 122 | 82 | 18 | T1100G | 33 | 675 |
| Toray Industries, Inc. | 9255S-7A | 0.056 | 92 | 78 | 22 | M40S | 40 | 470 |
| Toray Industries, Inc. | 9255S-6A | 0.047 | 76 | 76 | 24 | M40S | 40 | 470 |
| Toray Industries, Inc. | 9053S-4 | 0.027 | 43 | 70 | 30 | M40S | 40 | 470 |
| Nippon Graphite Fiber Corporation | E1026A-09N | 0.100 | 151 | 63 | 37 | XN-10 | 10 | 190 |
| Nippon Graphite Fiber Corporation | E1026A-14N | 0.150 | 222 | 63 | 37 | XN-10 | 10 | 190 |

The tensile strength and the tensile elastic modulus are measured in accordance with "Testing Method for Carbon Fibers" JIS R7601: 1986.

TABLE 2

| Examples of utilizable prepregs | | | | | | | | |
|---|---|---|---|---|---|---|---|---|
| | | | Weight | | | Physical property value of reinforcing fiber | | |
| Manufacturer | Trade name | Thickness of sheet (mm) | per unit area ($g/m^2$) | Fiber content (% by weight) | Resin content (% by weight) | Part number of fiber | Tensile elastic modulus ($t/mm^2$) | Tensile strength ($kgf/mm^2$) |
| Mitsubishi Chemical Corporation | GE352H-160S | 0.150 | 246 | 65 | 35 | E glass | 7 | 320 |
| Mitsubishi Chemical Corporation | TR350C-100S | 0.083 | 133 | 75 | 25 | TR50S | 24 | 500 |
| Mitsubishi Chemical Corporation | TR350U-100S | 0.078 | 126 | 75 | 25 | TR50S | 24 | 500 |
| Mitsubishi Chemical Corporation | TR350C-125S | 0.104 | 167 | 75 | 25 | TR50S | 24 | 500 |
| Mitsubishi Chemical Corporation | TR350C-150S | 0.124 | 200 | 75 | 25 | TR50S | 24 | 500 |
| Mitsubishi Chemical Corporation | TR350C-175S | 0.147 | 233 | 75 | 25 | TR50S | 24 | 500 |
| Mitsubishi Chemical Corporation | MR350J-025S | 0.034 | 48 | 63 | 37 | MR40 | 30 | 450 |
| Mitsubishi Chemical Corporation | MR350J-050S | 0.058 | 86 | 63 | 37 | MR40 | 30 | 450 |
| Mitsubishi Chemical Corporation | MR350C-050S | 0.05 | 67 | 75 | 25 | MR40 | 30 | 450 |
| Mitsubishi Chemical Corporation | MR350C-075S | 0.063 | 100 | 75 | 25 | MR40 | 30 | 450 |
| Mitsubishi Chemical Corporation | MRX350C-075R | 0.063 | 101 | 75 | 25 | MR40 | 30 | 450 |
| Mitsubishi Chemical Corporation | MRX350C-100S | 0.085 | 133 | 75 | 25 | MR40 | 30 | 450 |
| Mitsubishi Chemical Corporation | MR350C-100S | 0.085 | 133 | 75 | 25 | MR40 | 30 | 450 |
| Mitsubishi Chemical Corporation | MRX350C-125S | 0.105 | 167 | 75 | 25 | MR40 | 30 | 450 |
| Mitsubishi Chemical Corporation | MRX350C-150S | 0.125 | 200 | 75 | 25 | MR40 | 30 | 450 |
| Mitsubishi Chemical Corporation | MR350C-125S | 0.105 | 167 | 75 | 25 | MR40 | 30 | 450 |
| Mitsubishi Chemical Corporation | MR350E-100S | 0.093 | 143 | 70 | 30 | MR40 | 30 | 450 |
| Mitsubishi Chemical Corporation | HRX350C-075S | 0.057 | 92 | 75 | 25 | HR40 | 40 | 450 |
| Mitsubishi Chemical Corporation | HRX350C-110S | 0.082 | 132 | 75 | 25 | HR40 | 40 | 450 |

The tensile strength and the tensile elastic modulus are measured in accordance with "Testing Method for Carbon Fibers" JIS R7601:1986.

EXAMPLES

Example 1

A shaft having the same configuration as the shaft 6 was produced in accordance with the above-described manufacturing processes. The structure of sheets of the shaft was as shown in FIG. 2. The length Ls of the shaft was 1168 mm. The shaft weight was 47 g. The shaft torque was 6.2°. A driver head and a grip were attached to the produced shaft to obtain a golf club. As the driver head, a head of the trade name "SRIXON ZX7 driver" (loft angle 10.5°) manufactured by Sumitomo Rubber Industries, Ltd. was used.

In Example 1, layers other than the tip partial straight layer s1 were carbon fiber reinforced layers, but the tip partial straight layer sl was a glass fiber reinforced layer. As the glass fiber reinforced layer, a glass fiber reinforced prepreg having a fiber elastic modulus (tensile elastic modulus) of 7 $t/mm^2$ was used. The thickness of the layer s7 (the second hoop layer f2) was 0.034 mm. As the prepreg of the layer s7, the trade name "805S-3" manufactured by Toray Industries, Inc. was used. The thickness of the layer s12 (the third hoop layer f3) was 0.028 mm. As the prepreg of the layer s12, the trade name "8053S-3" manufactured by Toray Industries, Inc. was used. The length L1 was 500 mm. The length L2 was 720 mm. The length of the tip partial straight layer s11 was 698 mm.

The strength of Example 1 was as follows. The three-point flexural strength at the position located 90 mm apart from the tip end Tp was 205 kgf, the three-point flexural strength at the position located 175 mm apart from the tip end Tp was 78 kgf, the three-point flexural strength at the position located 525 mm apart from the tip end Tp was 73 kgf, and the three-point flexural strength at the position located 175 mm apart from the butt end Bt was 105 kgf. The impact absorbing energy of the tip portion was 3.7 J. The crushing strength at the position located 550 mm apart from the tip end Tp was 19 kgf, the crushing strength at the position located 650 mm apart from the tip end Tp was 18 kgf, the crushing strength at the position located 750 mm apart from the tip end Tp was 17 kgf, the crushing strength at the position located 850 mm apart from the tip end Tp was 16.5 kgf, and the crushing strength at the position located 950 mm apart from the tip end Tp was 16 kgf. The measurement methods of the three-point flexural strength, the impact absorbing energy and the crushing strength were as described above.

Example 2

A shaft and a golf club of Example 2 were obtained in the same manner as in Example 1 except that the prepreg of the second hoop layer f2 was the same as the prepreg of the third hoop layer f3 (thickness: 0.028 mm).

Comparative Example 1

A shaft and a golf club of Comparative Example 1 were obtained in the same manner as in Example 1 except that the second hoop layer f2 was removed.

Comparative Example 2

A shaft and a golf club of Comparative Example 2 were obtained in the same manner as in Example 1 except that the length L2 of the second hoop layer f2 was reduced to be the same as the length L1 of the first hoop layer f1.

Comparative Example 3

A shaft and a golf club of Comparative Example 3 were obtained in the same manner as in Example 1 except that the second butt straight layer b2 was replaced with a hoop layer that is formed with the same prepreg as that of the second butt straight layer b2 and different from the second butt straight layer b2 in only fiber orientation.

The following Table 3 shows evaluation results of Examples and Comparative Examples.

TABLE 3

Specifications and Evaluation Results of Examples and Comparative Examples

| | Unit | Example 1 | Example 2 | Comparative Example 1 | Comparative Example 2 | Comparative Example 3 |
|---|---|---|---|---|---|---|
| Forward flex | mm | 105 | 105 | 106 | 105 | 111 |
| Backward flex | mm | 95 | 95 | 95 | 95 | 95 |
| F5 | kgf | 19.0 | 18.5 | 15.0 | 15.0 | 16.0 |
| F9 | kgf | 16.0 | 15.0 | 10.0 | 16.0 | 11.0 |
| D5 | mm | 11.8 | 11.8 | 11.7 | 11.7 | 11.8 |
| D9 | mm | 14.8 | 14.8 | 14.7 | 14.8 | 14.8 |
| F5/D5 | kfg/mm | 1.61 | 1.57 | 1.28 | 1.28 | 1.36 |
| F9/D9 | kgf/mm | 1.08 | 1.01 | 0.68 | 1.08 | 0.74 |
| F5 − F9 | kgf | 3.0 | 3.5 | 5.0 | −1.0 | 5.0 |
| Feeling | on the scale of one to ten | 9.8 | 9.2 | 6.8 | 8.0 | 6.2 |

The evaluation methods of the forward flex, the backward flex and the strength were as described above. The evaluation method of feeling was as described below.

<Feeling>

Five athlete-type golfers who swing a driver at a head speed of 43 to 46 m/s or greater each hit a golf ball five times using each of the clubs. The five testers evaluated shaft feeling on a scale of one to ten. The higher the score is, the better the feeling is. As the golf ball, the trade name "SRIXON Z-STAR XV" manufactured by Sumitomo Rubber Industries, Ltd. was used. The average values of the evaluated scores for respective clubs are shown in the above Table 3.

As shown in Table 3, Examples are highly evaluated as compared with Comparative Examples.

The following clauses are a part of invention included in the present disclosure.

[Clause 1]

A golf club shaft formed by a plurality of fiber reinforced resin layers and including a tip end and a butt end, wherein the golf club shaft has a shaft weight of less than or equal to 50 g, the golf club shaft has a forward flex of less than or equal to 110 mm and a backward flex of less than or equal to 100 mm, the golf club shaft has a shaft torque of greater than or equal to 4.0° and less than or equal to 6.5°, the fiber reinforced resin layers include a first hoop layer that is disposed from the butt end to a first position, a second hoop layer that is longer than the first hoop layer and is disposed from the butt end to a second position, and a third hoop layer that is longer than the second hoop layer and is disposed from the butt end to a third position, when an outer diameter of the golf club shaft at a position located 550 mm apart from the tip end is denoted by D5 (mm), an outer diameter of the golf club shaft at a position located 950 mm apart from the tip end is denoted by D9 (mm), a crushing strength at the position located 550 mm apart from the tip end is denoted by F5 (kgf), and a crushing strength at the position located 950 mm apart from the tip end is denoted by F9 (kgf), then F5/D5 is greater than or equal to 1.5 and less than or equal to 2.5, F9/D9 is greater than or equal to 1.0 and less than or equal to 2.0, and a difference (F5−F9) is less than or equal to 4 kgf.

[Clause 2]

The golf club shaft according to clause 1, wherein a three-point flexural strength at a position located 90 mm apart from the tip end is greater than or equal to 190 kgf, a three-point flexural strength at a position located 175 mm apart from the tip end is greater than or equal to 70 kgf, a three-point flexural strength at a position located 525 mm apart from the tip end is greater than or equal to 65 kgf, and a three-point flexural strength at a position located 175 mm apart from the butt end is greater than or equal to 90 kgf, an impact absorbing energy of a tip portion of the golf club shaft is greater than or equal to 3.4 J, and a crushing strength at the position located 550 mm apart from the tip end is greater than or equal to 11 kgf, a crushing strength at a position located 650 mm apart from the tip end is greater than or equal to 11 kgf, a crushing strength at a position located 750 mm apart from the tip end is greater than or equal to 11 kgf, a crushing strength at a position located 850 mm apart from the tip end is greater than or equal to 11 kgf, and a crushing strength at the position located 950 mm apart from the tip end is greater than or equal to 11 kgf.

[Clause 3]

The golf club shaft according to clause 1 or 2, wherein the first hoop layer and the second hoop layer are butt partial hoop layers, the third hoop layer is a full length hoop layer, the second hoop layer is disposed on an outer side than the first hoop layer, and the third hoop layer is disposed on the outer side than the second hoop layer.

[Clause 4]

The golf club shaft according to clause 3, wherein the first hoop layer has a length of greater than or equal to 300 mm and less than or equal to 550 mm, and the second hoop layer has a length of greater than or equal to 500 mm and less than or equal to 775 mm.

[Clause 5]

The golf club shaft according to any one of clauses 1 to 4, wherein the fiber reinforced resin layers include a tip partial layer, and the tip partial layer includes a low elastic tip partial layer that has a fiber elastic modulus of less than or equal to 10 t/mm$^2$.

[Clause 6]

The golf club shaft according to any one of clauses 1 to 5, wherein the first hoop layer and/or the second hoop layer is thicker than the third hoop layer.

[Clause 7]

The golf club shaft according to any one of clauses 1 to 6, wherein the fiber reinforced resin layers include a plurality of tip partial straight layers having respective lengths different from each other and a plurality of butt partial straight layers having respective lengths different from each other, the tip partial straight layers include a longest tip straight layer, the butt partial straight layers include a longest butt straight layer, and an overlapping portion in which the longest tip straight layer and the longest butt straight layer overlap each other in an axial direction is formed.

[Clause 8]

The golf club shaft according to clause 7, wherein a center in the axial direction of the overlapping portion is located between the first position and the second position, and the second hoop layer is disposed in the overlapping portion.

LIST OF REFERENCE SYMBOLS

2 Golf club
4 Head
6 Shaft
8 Grip
s1 to s16 Prepreg sheets (layers)
f1 First hoop layer
f2 Second hoop layer
f3 Third hoop layer
P1 First position
P2 Second position
P3 Third position
b1 First butt straight layer
b2 Second butt straight layer
m1 Longest tip straight layer
m2 Longest butt straight layer
Bt Butt end
Tp Tip end The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising", "having", "including", and "containing" are to be construed as open-ended terms (i.e., meaning "including, but not limited to,") unless otherwise noted.

What is claimed is:

1. A golf club shaft formed by a plurality of fiber reinforced resin layers and comprising a tip end and a butt end, wherein the golf club shaft has a shaft weight of less than or equal to 50 g, the golf club shaft has a forward flex of less than or equal to 110 mm and a backward flex of less than or equal to 100 mm, the golf club shaft has a shaft torque of greater than or equal to 4.0° and less than or equal to 6.5°, the fiber reinforced resin layers include a first hoop layer that is disposed from the butt end to a first position, a second hoop layer that is longer than the first hoop layer and is disposed from the butt end to a second position, and a third hoop layer that is longer than the second hoop layer and is disposed from the butt end to a third position, and when an outer diameter of the golf club shaft at a position located 550 mm apart from the tip end is denoted by D5 (mm), an outer diameter of the golf club shaft at a position located 950 mm apart from the tip end is denoted by D9 (mm), a crushing strength at the position located 550 mm apart from the tip end is denoted by F5 (kgf), and a crushing strength at the position located 950 mm apart from the tip end is denoted by F9 (kgf), then, F5/D5 is greater than or equal to 1.5 and less than or equal to 2.5, F9/D9 is greater than or equal to 1.0 and less than or equal to 2.0, and a difference (F5-F9) is less than or equal to 4 kgf.

2. The golf club shaft according to claim 1, wherein a three-point flexural strength at a position located 90 mm apart from the tip end is greater than or equal to 190 kgf, a three-point flexural strength at a position located 175 mm apart from the tip end is greater than or equal to 70 kgf, a three-point flexural strength at a position located 525 mm apart from the tip end is greater than or equal to 65 kgf, and a three-point flexural strength at a position located 175 mm apart from the butt end is greater than or equal to 90 kgf, an impact absorbing energy of a tip portion of the golf club shaft is greater than or equal to 3.4 J, and a crushing strength at the position located 550 mm apart from the tip end is greater than or equal to 11 kgf, a crushing strength at a position located 650 mm apart from the tip end is greater than or equal to 11 kgf, a crushing strength at a position located 750 mm apart from the tip end is greater than or equal to 11 kgf, a crushing strength at a position located 850 mm apart from the tip end is greater than or equal to 11 kgf, and a crushing strength at the position located 950 mm apart from the tip end is greater than or equal to 11 kgf.

3. The golf club shaft according to claim 1, wherein the first hoop layer and the second hoop layer are butt partial hoop layers, the third hoop layer is a full length hoop layer, the second hoop layer is disposed on an outer side than the first hoop layer, and the third hoop layer is disposed on the outer side than the second hoop layer.

4. The golf club shaft according to claim 3, wherein the first hoop layer has a length of greater than or equal to 300 mm and less than or equal to 550 mm, and the second hoop layer has a length of greater than or equal to 500 mm and less than or equal to 775 mm.

5. The golf club shaft according to claim 1, wherein the fiber reinforced resin layers include a tip partial layer, and the tip partial layer includes a low elastic tip partial layer that has a fiber elastic modulus of less than or equal to 10 t/mm$^2$.

6. The golf club shaft according to claim 1, wherein the first hoop layer and/or the second hoop layer is thicker than the third hoop layer.

7. The golf club shaft according to claim 1, wherein the fiber reinforced resin layers include a plurality of tip partial straight layers having respective lengths different from each other and a plurality of butt partial straight layers having respective lengths different from each other, the tip partial straight layers include a longest tip straight layer, the butt partial straight layers include a longest butt straight layer, and an overlapping portion in which the longest tip straight layer and the longest butt straight layer overlap each other in an axial direction is formed.

8. The golf club shaft according to claim 7, wherein a center in the axial direction of the overlapping portion is located between the first position and the second position, and the second hoop layer is disposed in the overlapping portion.

9. A golf club shaft formed by a plurality of fiber reinforced resin layers and comprising a tip end and a butt end, wherein the golf club shaft has a shaft weight of less than or equal to 50 g, the fiber reinforced resin layers include a first hoop layer that is disposed from the butt end to a first position, a second hoop layer that is longer than the first hoop layer and is disposed from the butt end to a second position, and a third hoop layer that is longer than the second hoop layer and is disposed from the butt end to a third position, the first hoop layer and the second hoop layer are butt partial hoop layers, the third hoop layer is a full length hoop layer, the second hoop layer is disposed on an outer side than the first hoop layer, the third hoop layer is disposed on the outer side than the second hoop layer, and the first hoop layer and/or the second hoop layer is thicker than the third hoop layer and when an outer diameter of the golf club shaft at a position located 550 mm apart from the tip end is denoted by D5 (mm), an outer diameter of the golf club shaft at a position located 950 mm apart from the tip end is denoted by D9 (mm), a crushing strength at the position located 550 mm apart from the tip end is denoted by F5 (kgf), and a crushing strength at the position located 950 mm apart from the tip end is denoted by F9 (kgf), then:

F5/D5 is greater than or equal to 1.5 and less than or equal to 2.5,

F9/D9 is greater than or equal to 1.0 and less than or equal to 2.0, and a difference (F5-F9) is less than or equal to 4 kgf.

10. The golf club shaft according to claim 9, wherein the first hoop layer has a length of greater than or equal to 300 mm and less than or equal to 550 mm, and the second hoop layer has a length of greater than or equal to 500 mm and less than or equal to 775 mm.

11. The golf club shaft according to claim 9, wherein the fiber reinforced resin layers include a tip partial layer, and the tip partial layer includes a low elastic tip partial layer that has a fiber elastic modulus of less than or equal to 10 t/mm$^2$.

12. The golf club shaft according to claim 9, wherein the fiber reinforced resin layers include a plurality of tip partial straight layers having respective lengths different from each other and a plurality of butt partial straight layers having respective lengths different from each other, the tip partial straight layers include a longest tip straight layer, the butt partial straight layers include a longest butt straight layer, and an overlapping portion in which the longest tip straight layer and the longest butt straight layer overlap each other in an axial direction is formed.

13. The golf club shaft according to claim 12, wherein a center in the axial direction of the overlapping portion is located between the first position and the second position, and the second hoop layer is disposed in the overlapping portion.

14. The golf club shaft according to claim 9, wherein the golf club shaft has a forward flex of less than or equal to 110 mm and a backward flex of less than or equal to 100 mm.

15. The golf club shaft according to claim 9, wherein the golf club shaft has a shaft torque of greater than or equal to 4.0° and less than or equal to 6.5°.

16. A golf club shaft formed by a plurality of fiber reinforced resin layers and comprising a tip end and a butt end, wherein the golf shaft has a shaft weight of less than or equal to 50 g, the fiber reinforced resin layers include a first hoop layer that is disposed from the butt end to a first position, a second hoop layer that is longer than the first hoop layer and is disposed from the butt end to a seco ad position, and a third hoop layer that is longer than the second hoop layer and is disposed from the butt end to a third position, the first hoop layer and the second hoop layer are bott partial hoop lavers, the third hoop layer is a full length hoop layer, the second hoop layer is displayed an outer side than the first hoop layer, the third hoop layer is disposed on the outer side than the second hoop layer, the first hoop layer and/or the second hoop layer is thicker than the third hoop layer a three-point flexural strength at a position located 90 mm apart from the tip end is greater than or equal to 190 kgf, a three-point flexural strength at a position located 175 mm apart from the tip end is greater than or equal to 70 kgf, a three-point flexural strength at a position located 525 mm apart from the tip end is greater than or equal to 65 kgf, and a three-point flexural strength at a position located 175 mm apart from the butt end is greater than or equal to 90 kgf, an impact absorbing energy of a tip portion of the golf club shaft is greater than or equal to 3.4 J, and a crushing strength at a position located 550 mm apart from the tip end is greater than or equal to 11 kgf, a crushing strength at a position located 650 mm apart from the tip end is greater than or equal to 11 kgf, a crushing strength at a position located 750 mm apart from the tip end is greater than or equal to 11 kgf, a crushing strength at a position located 850 mm apart from the tip end is greater than or equal to 11 kgf, and a crushing strength at a position located 950 mm apart from the tip end is greater than or equal to 11 kgf.

* * * * *